US005630661A

United States Patent [19]

Fox

[11] Patent Number: 5,630,661

[45] Date of Patent: May 20, 1997

[54] METAL ARC FLASHLIGHT

[76] Inventor: Donald P. Fox, 2421 Jefferson Ave., Berkeley, Calif. 94703

[21] Appl. No.: 597,601

[22] Filed: Feb. 6, 1996

[51] Int. Cl.[6] ..... F21L 9/00

[52] U.S. Cl. ..... 362/187; 362/322; 362/293; 362/282

[58] Field of Search ..... 362/183, 187, 362/202, 277, 280, 323, 263, 282, 319, 322, 293, 324, 284, 186

[56] References Cited

U.S. PATENT DOCUMENTS

| | | | |
|---|---|---|---|
| 1,621,955 | 3/1927 | Schiffner | 362/187 |
| 3,702,395 | 11/1972 | Rosendahl . | |
| 3,940,606 | 2/1976 | Lemons . | |
| 5,014,171 | 5/1991 | Price, III | 362/277 |
| 5,031,080 | 7/1991 | Aikens et al. | 362/187 |
| 5,068,768 | 11/1991 | Kobayashi | 362/277 |
| 5,072,346 | 12/1991 | Harding | 362/187 |
| 5,124,891 | 6/1992 | Blusseau | 362/61 |
| 5,285,362 | 2/1994 | Sakata | 362/263 |
| 5,299,101 | 3/1994 | Serizawa | 362/61 |
| 5,343,370 | 8/1994 | Ohashi et all | 362/61 |
| 5,369,557 | 11/1994 | Ronney | 362/285 |
| 5,388,034 | 2/1995 | Allen et al. | 362/61 |
| 5,412,548 | 5/1995 | Yee | 362/277 |

*Primary Examiner*—Ira S. Lazarus
*Assistant Examiner*—Thomas M. Sember
*Attorney, Agent, or Firm*—Bruce & McCoy

[57] ABSTRACT

A rechargeable metal arc flashlight having a light generating assembly which utilizes a metal halide arc lamp mounted inside an elliptical reflector for focusing emitted light onto a diffusion screen. The flashlight utilizes a moveable collimating lens disposed in front of the screen to focus light from the screen into a collimated beam or a floodlight which is passed through a UV blocking filter. The flashlight includes a rechargable self-contained power source for igniting and sustaining ignition of the arc lamp.

6 Claims, 3 Drawing Sheets

METAL ARC FLASHLIGHT

BACKGROUND OF THE INVENTION

1. Field of the Invention

The present invention relates to flashlights and, more particularly, to a portable metal halide are discharge flashlight utilizing electronic circuitry, a light diffuser, and an adjustable lens.

2. Description of the Prior Art

Handheld flashlights generally utilize tungsten filaments to produce their light. Such lights are limited in their brightness due to the fact that incandescent tungsten can produce only so many lumens per watt of power. More recent evolution flashlights, employing high-tech design, utilize highly loaded tungsten halogen lamps with high efficiency reflectors to produce a higher light output. While these flashlights can produce a bright light in spotlight mode, they cannot produce alternatively a wide, even field, bright floodlight beam. Since the light from the incandescent tungsten element radiates light in the longer part of the electromagnetic spectrum, the light from a tungsten element tends to be more yellow than daylight, and it is therefore more difficult to see by. Therefore, there is a need for a flashlight that can produce more light emitting lumens per watt of power at a higher color temperature with a more even and variable field of illumination than the present high-tech tungsten halogen flashlights.

A typical metal halide lamp is over three times brighter than a comparable tungsten filament light. These lamps have long been used for special lighting purposes such as spotlights in theaters. An important feature of such a lamp is that there is no filament to break if a metal halide lamp is dropped. There are numerous different types of metal halide lamps in use, but until the present invention, none of the designs were capable of being reduced in size to typical flashlight proportions.

SUMMARY OF THE INVENTION

The present invention is a portable metal halide arc discharge flashlight with an output in the "spot" position which is over 500,000 candle power with a running time of approximately 50 minutes on a single charge. It includes a light generating assembly with a metal halide arc lamp mounted inside an elliptical reflector. The reflector focuses the light emitted by the lamp down to a spot located at a predetermined minimal distance in front of the lamp and reflector combination. A lens assembly is located in front of the arc lamp and includes a diffusion screen located at the predetermined distance in front of the arc lamp where the light is focused. A collimating lens is disposed in front of the diffusion screen to angulate the light emerging from the screen, and a UV blocking filter is disposed in front of the collimating lens. A means is provided for changing the distance between the collimating lens and the focus point of the elliptical reflector. A rechargeable battery is disposed adjacent to the light generating assembly and has electric contacts. An electronic ballast is provided for converting battery voltage to the voltage required to operate the metal arc lamp and for supplying a high-voltage pulse that ionizes the gas inside the lamp to initiate lamp ignition. Electrical circuitry is provided for electrically connecting the electronic ballast to the lamp and the ballast to the electrical contacts of said battery. The circuitry includes an on/off switch for controlling the flow of electricity from the battery to the ballast, and external electrical input connections are provided for effecting the recharging of the battery. A container encloses the components.

OBJECTS OF THE INVENTION

It is therefore an important object of the present invention to provide a portable metal halide arc discharge lamp in normal flashlight size and configuration.

It is another object of the present invention to provide a metal are flashlight which produces a variable light field that can be adjusted from a focused light beam to a wide angle field floodlight of even illumination.

It is yet a further object of the present invention to provide a rugged flashlight in which the lamp can resist severe deceleration from being dropped or banged against a solid object by the user.

And it is still another object of the present invention to provide a portable flashlight of high powered illumination several times greater than a tungsten halogen lamp flashlight.

Other objects and advantages of the present invention will become apparent when the apparatus of the present invention is considered in conjunction with the accompanying drawings.

DESCRIPTION OF THE PREFERRED EMBODIMENT

Reference is made to the drawings for a description of the preferred embodiment of the present invention wherein like reference numbers represent like elements on corresponding views.

Figure 1:
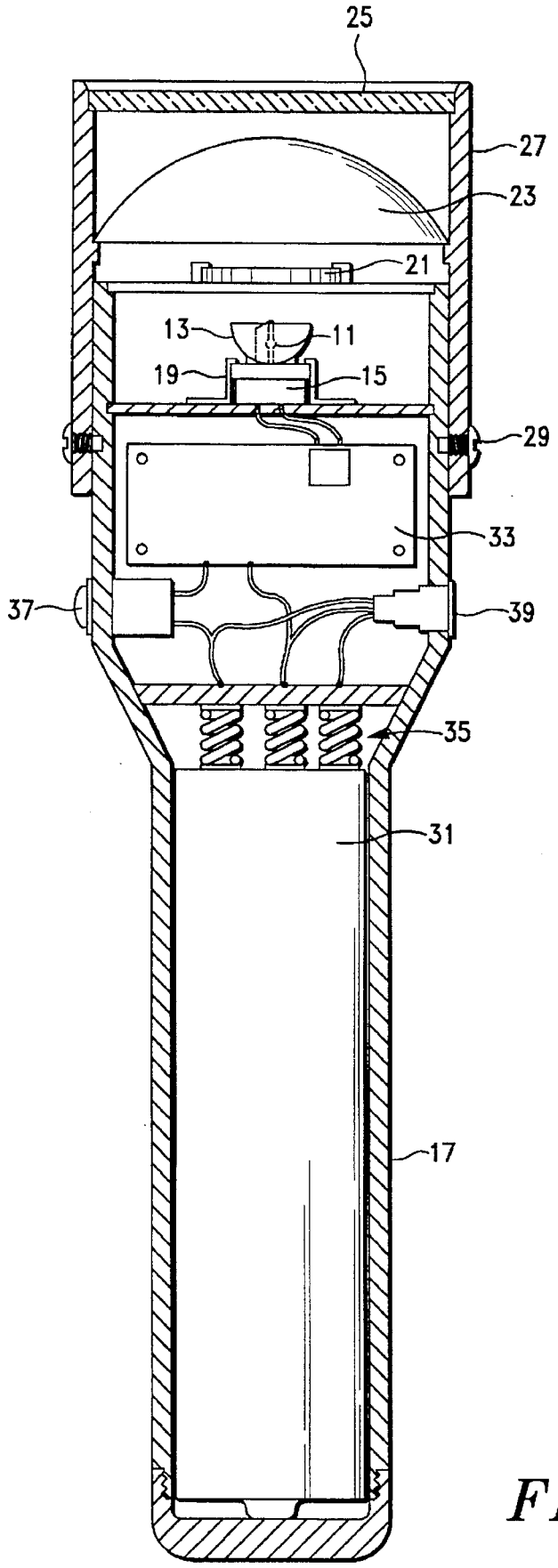
FIG. 1 is a side elevation in cross-section of the metal arc flashlight of the present invention.
Figure 5:
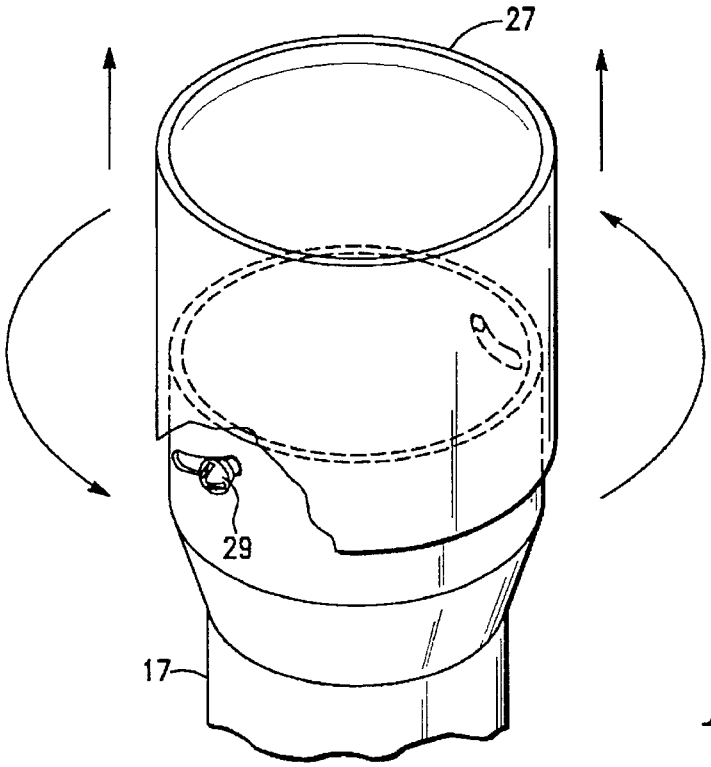
FIG. 5 is a perspective view showing the moveable portion of the lens assembly and its engagement to the container.

Reference is made to FIGS. 1 and 5. The present invention is comprised of several sub-assemblies. The first is a light-generating assembly which includes a metal halide arc lamp 11 mounted inside an elliptical reflector 13. The reflector is designed to focus light emitted by the lamp at a minimal or short distance in front of the lamp and reflector combination. In the preferred embodiment, that distance is approximately one-half inch although it can vary considerably based simply on the desired proportions of the flashlight configuration and the curvature of the elliptical reflector. in the preferred embodiment of the present invention, the are light 11 is a 24-watt metal halide lamp mounted inside the reflector 13 and base 15. The lamp is a standard unit mounted to a universal socket in the base which, in turn, is held in place in the flashlight container 17 by spring clips 19. The elliptical reflector focuses the light from the luminescent tube 11 down to a small point at the focus of the reflector.

A lens assembly is located in front of the light generating assembly of the arc lamp 11 and reflector 13 and also includes several elements. The first element is a diffusion screen 21 which is fixed in position and located in front of the arc lamp at the focal point of the light generating assembly.

In the preferred embodiment of the invention, the screen can be a fiberoptic diffusion plate 21 which is a commercially available item. The fiberglass fibers are stacked in parallel alignment and fuzed into a thin plate and the aligned ends on both sides of the plate are polished. The diffuser is very efficient and allows a large mount of the light focused thereon to pass therethrough.

The purpose of the fiberoptic diffusion screen 21 is to diffuse and make more uniform the light from the reflector lamp unit. The reflector surface has slight imperfections in its surface which show up as dark areas in the light field. Also, where the luminescent tube of the arc lamp 11 protrudes through the reflector 13, there is a large hole which can also create a dark area in the center of the field of light. The fiberoptic diffusion screen removes most of these imperfections in the light field without reducing the light level from the lamp reflector unit. The screen creates an even field of high light output from the reflector lamp.

Alternatively, instead of a fiberoptic diffusion plate, a light shaping diffuser (LSD) could be utilized to homogenize the light. An LSD is an off-the-shelf item designed to diffuse light via refraction through holographic means. It is formed with a holographic surface relief screen that transmits more than 80% of the light as opposed to 50–75% with a fiberoptic screen. An LSD is made up of devices that are random, nonperiodic structures that shape a light beam by precisely controlling the energy distribution along the horizontal and vertical axis. The diffusers can be embossed into a deformable material such as acrylic or glass and are unique holographic optical elements that will accept incoming light, then homogenize and redistribute it over a predetermined angular spread (0.2 to 100 degrees circular and elliptical ratios of up to 400:1.

Figure 4:
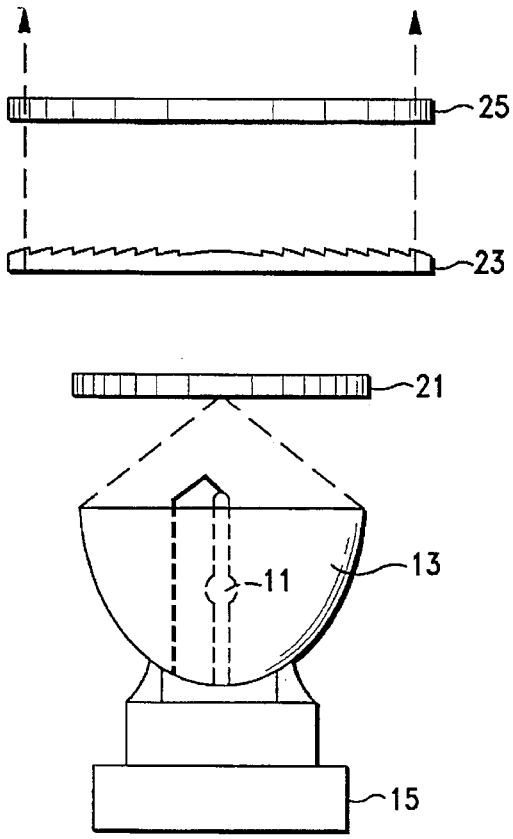
FIG. 4 is a schematic representation of the assembly of the present invention employing a fresnel lens.

A collimating lens 23 is another element of the lens assembly, and it is disposed in front of the diffusion screen 21 to angulate the light emerging therefrom. The collimating lens can be either an aspheric condensing lens or a fresnel condensing lens. An aspheric condensing lens is usually made of glass, whereas the fresnel lens shown in FIG. 4 is usually made of plastic for light weight and strength. Either one, however, could be cast or molded from plastic for effecting cost reduction in manufacturing.

Figure 2:
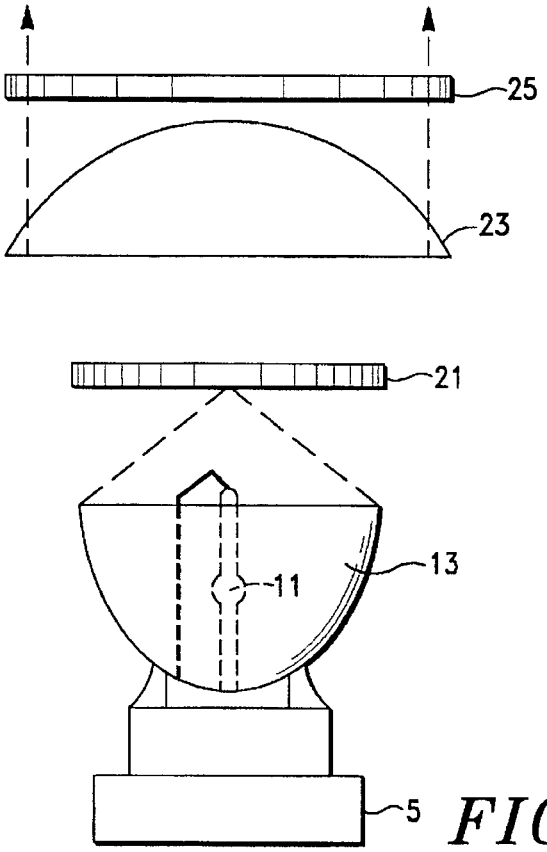
FIG. 2 is a schematic representation of the assembly of the present invention showing the present invention in light beam mode.
Figure 3:
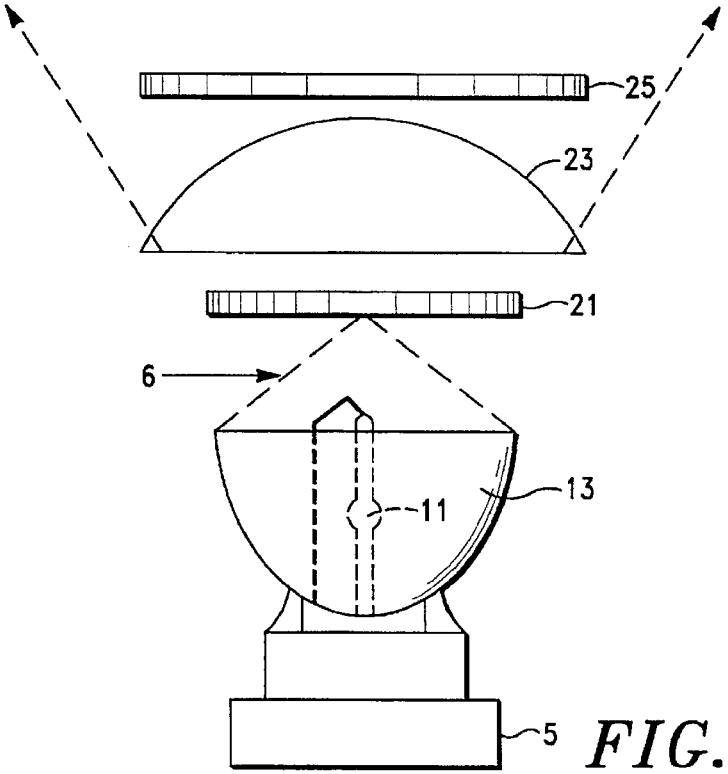
FIG. 3 is a schematic representation of the assembly of the present invention showing the present invention in floodlight mode.

The purpose of the collimating or condensing lens 23 is basically to focus and collimate the light emerging from the diffusion screen 21. The aspheric lens increases the f-stop of the system by shortening the focal length of the lens which increases the light transmission of the system. By adjusting the instance of the collimating lens from the diffusion screen, which is fixed at the focus point of the elliptical reflector 13, the light beam can be made to transform from a wide angle flood to a narrow or zero angle collimated beam as shown in FIGS. 2 and 3. This is to permit the light emitted by the lamp to be varied from a floodlight to a spot beam.

The last element of the lens assembly is a UV blocking filter 25 which is disposed in front of the condensing lens 23. The filter reduces UV Illumination and protects the collimating lens from damage. Reducing UV illumination protects the operator and persons illuminated by the light from UV exposure and possible eye damage. The UV filter is usually fixed in position in relation to the collimating lens and moves with it in the flashlight assembly. It is part of the moveable lens assembly. Essentially, however, only the collimating lens and its holder 27 necessarily constitute the moveable portion of the lens assembly as the UV filter does not need to be fixed in position relative to the condensing lens.

Reference is made to FIG. 5. The transformation of the light beam from a collimated spot beam to a floodlight is effected by reciprocating the moveable portion of the lens assembly, the condensing lens 23 and possibly the UV filter 25, as a unit to various positions in front of the light generating assembly and the fixed location fiberoptic diffusion screen 21. The position of the moveable portion of the lens assembly, is changed or altered by rotating the lens barrel 27, which is engaged in the flashlight housing or container 17 via set screws 29 which are screwed through the barrel and the ends of which engage and ride in a double spiral formed in the body 27, causing the moveable portion of the lens assembly to move in and out by the rotation of the barrel 27 on the flashlight body 17.

An alternative arrangement for effecting the transformation of the light beam from wide angle floodlight to narrow angle collimated or beam light utilizes a fixed position condensing lens and UV filter with a moveable lamp, reflector, and diffuser unit, but such an assembly is more complicated and expensive to construct. However, the present invention contemplates both arrangements and claims such.

In some prior art flashlight designs, the movement of the lens assembly includes a fixed configuration flat lens and light bulb combination formed as a unit, and the lens and bulb are moved longitudinally in the flashlight barrel for the purpose of contacting the battery. In the present invention, the lamp assembly is separate from the collimating assembly lens and is fixed in the flashlight barrel and only the lens moves with respect to the barrel. However, a similar mechanical arrangement is utilized to move the lens assembly apart from the lamp as with the prior art flashlights that move the flat lens and light bulb longitudinally with respect to the flashlight barrel.

A power source assembly is disposed adjacent to the light generating assembly and has electrical contacts. In the preferred embodiment, a rechargeable 30-watt nickel metal hydride battery 31 is utilized as the optimum size.

A standard unit electronic ballast 33 is provided for converting the battery voltage to the voltage required to operate the metal arc lamp 11 and for supplying a high-voltage pulse that ionizes the gas inside the lamp to initiate lamp ignition. In the preferred embodiment, the electronic ballast converts the low voltage of the battery 31 to the desired power output of approximately 60 volts and a current of about 400 milliamps.

Electrical circuitry is provided for connecting the electronic ballast 33 to the lamp 11 and the ballast to the electrical contacts of the battery 31 through spring contactors 35. The circuitry delivers electrical energy from the power source to the light generating assembly. The circuitry includes an on and off switch 37 for controlling the flow of electricity from the battery to the ballast. External electrical input jacks 39 are provided with connections for effecting the recharging of the battery.

A container is provided for enclosing the components. It is similar to prior art flashlight bodies except for the arrangement and composition of the components which produce the restful of a new and improved metal are flashlight which produces both collimated beam and floodlight of high intensity.

Reference is made to FIGS. 2 and 3 which show the positioning of the lens assembly for transforming the flashlight from beam mode to floodlight and the resulting light beam angulation in the two different modes. FIG. 2 shows the aspheric condensing lens 23 disposed spaced from the focus point of the elliptical reflector 23 the exact distance that the curvature of lens dictates so that the light beam from the diffusion screen 21 is collimated by the condensing lens. The dotted lines represent the edges of the light field to the focal point of the elliptical reflector. The light field between the diffuser screen and the condensing lens cannot be accurately represented by dotted lines in either FIGS. 2, 3, or 4. FIG. 3 shows the positioning of the condensing lens disposed closer to the diffusion screen than in FIG. 2. In this positioning, the light emanating from the condensing lens is dispensed to create a floodlight. Positioning the lens between these two positions permits an infinitely variable light emission between these two extremes.

FIG. 4 shows a frensel lens substituted for an aspheric lens and positioned in the same physical relationship to the focus point of the elliptical reflector as the aspheric lens in FIG. 2 whereby it transmits a collimated light beam the same as FIG. 2. Movement of the fresnel lens toward the focus point of the reflector creates a floodlight the same as in FIG. 3.

Thus, it will be apparent from the foregoing description of the invention in its preferred form that it will fulfill all the objects and advantages attributable thereto. While it is illustrated and described in considerable detail herein, the invention is not to be limited to such details as have been set forth except as may be necessitated by the appended claims.

We claim:

1. A metal arc flashlight comprising a light generating assembly including a metal halide arc lamp mounted inside an elliptical reflector which focuses the light emitted by said lamp down to a spot located at a predetermined minimal distance in front of said lamp and reflector, a lens assembly located in front of said arc lamp and reflector and including, a diffusion screen located at said predetermined distance in front of said lamp where said emitted light is focused, a collimating lens disposed in front of said diffusion screen to angulate the light emerging therefrom, a UV blocking filter disposed in front of said collimating lens, and means for changing the distance between said collimating lens and said focus point of said elliptical reflector, a rechargeable battery disposed adjacent to said light generating assembly and having electrical contacts, an electronic ballast for converting battery voltage to a voltage required to operate said metal are lamp and for supplying a high-voltage pulse that ionizes a gas inside said lamp to initiate lamp ignition, electrical circuitry for electrically connecting said electronic ballast to said lamp and said ballast to said electrical contacts of said battery, said circuitry including an on/off switch for controlling a flow of electricity from said battery to said ballast and external electrical input connections for effecting the recharging of said battery, and a container for enclosing said components.

2. The flashlight of claim 1 wherein said collimating lens can either be an aspheric condensing lens or a fresnel lens.

3. The flashlight of claim 1 wherein said screen is either a fiberoptic diffusion plate or a holographic light shaping diffuser.

4. The flashlight of claim 1 wherein said battery is a 30 watt nickel metal halide battery and said arc light is a 24-watt metal halide lamp.

5. The flashlight of claim 1 wherein said means for changing the location of said collimating lens includes a barrel containing said lens and which is slidably engaged with said container to permit said lens to be adjustable with respect to said light generating assembly.

6. A metal arc flashlight comprising a light generating assembly including a metal halide arc lamp mounted inside an elliptical reflector which focuses the light emitted by said lamp down to a spot located at a predetermined minimal distance in front of said lamp and reflector, a lens assembly located in front of said are lamp and reflector and including, either a fiberoptic diffusion screen or a holographic light shaping diffusion screen located at said predetermined distance in front of said lamp where said emitted light is focused, either an aspheric condensing lens or a fresnel lens disposed in front of said diffusion screen to angulate the light emerging therefrom, and a UV blocking filter disposed in front of said collimating lens, a rechargeable battery disposed adjacent to said light generating assembly and having electrical contacts, an electronic ballast for converting battery voltage to a voltage required to operate said metal are lamp and for supplying a high-voltage pulse that ionizes a gas inside said lamp to initiate lamp ignition, electrical circuitry for electrically connecting said electronic ballast to said lamp and said ballast to said electrical contacts of said battery, said circuitry including an on/off switch for controlling a flow of electricity from said battery to said ballast and external electrical input connections for effecting the recharging of said battery, a container for enclosing said components, and a means for changing the distance between said lens and said focus point of said elliptical reflector, including a barrel containing said lens which is slidably engaged with said container to permit said lens to be adjustably positioned with respect to said light generating assembly.

* * * * *